US008333233B2

(12) United States Patent
Abdel-Messeh et al.

(10) Patent No.: US 8,333,233 B2
(45) Date of Patent: Dec. 18, 2012

(54) AIRFOIL WITH WRAPPED LEADING EDGE COOLING PASSAGE

(75) Inventors: William Abdel-Messeh, Middletown, CT (US); Justin D. Piggush, Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 13/366,808

(22) Filed: Feb. 6, 2012

(65) Prior Publication Data

US 2012/0141289 A1 Jun. 7, 2012

Related U.S. Application Data

(62) Division of application No. 12/334,665, filed on Dec. 15, 2008, now Pat. No. 8,109,725.

(51) Int. Cl.
*B22C 9/10* (2006.01)

(52) U.S. Cl. ..... 164/369; 164/516

(58) Field of Classification Search ..... 164/28, 164/516, 369

See application file for complete search history.

(56) References Cited

U.S. PATENT DOCUMENTS

| | | | |
|---|---|---|---|
| 3,978,731 | A | 9/1976 | Reeder et al. |
| 5,486,093 | A | 1/1996 | Auxier et al. |
| 5,735,335 | A | 4/1998 | Gilmore et al. |
| 5,820,337 | A | 10/1998 | Jackson et al. |
| 6,000,906 | A | 12/1999 | Draskovich |
| 6,139,258 | A | 10/2000 | Lang, III et al. |
| 6,164,912 | A | 12/2000 | Tabbita et al. |
| 6,234,755 | B1 | 5/2001 | Bunker et al. |
| 6,247,896 | B1 | 6/2001 | Auxier et al. |
| 6,280,140 | B1 | 8/2001 | Soechting et al. |
| 6,607,355 | B2 | 8/2003 | Cunha et al. |
| 6,705,831 | B2 | 3/2004 | Draper |
| 6,890,154 | B2 | 5/2005 | Cunha |
| 6,896,487 | B2 | 5/2005 | Cunha et al. |
| 6,913,064 | B2 | 7/2005 | Beals et al. |
| 6,929,054 | B2 | 8/2005 | Beals et al. |
| 6,932,145 | B2 | 8/2005 | Frasier et al. |

(Continued)

FOREIGN PATENT DOCUMENTS

| | | |
|---|---|---|
| EP | 0 924 382 | 12/1998 |

OTHER PUBLICATIONS

Extended European Search Report for EP Application No. 10 00 5822, Dec. 6, 2010.

*Primary Examiner* — Kuang Lin

(74) *Attorney, Agent, or Firm* — Carlson, Gaskey & Olds, P.C.

(57) ABSTRACT

A turbine engine airfoil includes an airfoil structure having an exterior surface providing a leading edge. A radially extending first cooling passage is arranged near the leading edge and includes first and second portions. The first portion extends to the exterior surface and forms a radially extending trench in the leading edge. The second portion is in fluid communication with a second cooling passage. In one example, the second cooling passage extends radially, and the first cooling passage wraps around a portion of the second cooling passage from a pressure side to a suction side between the second cooling passage and the exterior surface. In the example, the first portion is arranged between the pressure and suction sides. In one example, the first cooling passage is formed by arranging a core in an airfoil mold. The trench is formed by the core in one example.

9 Claims, 3 Drawing Sheets

U.S. PATENT DOCUMENTS 6,932,571 B2 8/2005 Cunha et al.
6,955,522 B2 10/2005 Cunha et al.
6,994,521 B2 2/2006 Liang
7,014,424 B2 3/2006 Cunha et al.
7,097,424 B2 8/2006 Cunha et al.
7,097,425 B2 8/2006 Cunha et al.
7,108,045 B2 9/2006 Wiedemer et al.
7,131,818 B2 11/2006 Cunha et al.
7,137,776 B2 11/2006 Draper et al.
7,172,012 B1 2/2007 Memmen
7,174,945 B2 2/2007 Beals et al.
7,185,695 B1 3/2007 Santeler
7,216,689 B2 5/2007 Verner et al.
7,217,094 B2 5/2007 Cunha et al.
7,217,095 B2 5/2007 Pietraszkiewicz et al.
7,220,103 B2 5/2007 Cunha et al.
7,255,536 B2 8/2007 Cunha et al.
7,258,156 B2 8/2007 Santeler
7,270,170 B2 9/2007 Beals et al.
7,302,990 B2 12/2007 Bunker et al.
7,303,375 B2 12/2007 Cunha et al.
7,306,024 B2 12/2007 Beals et al.
7,306,026 B2 12/2007 Memmen
7,311,497 B2 12/2007 Sharma et al.
7,311,498 B2 12/2007 Cunha et al.
7,322,795 B2 1/2008 Luczak et al.
7,343,960 B1 3/2008 Frasier et al.
7,364,405 B2 4/2008 Cunha et al.
2005/0156361 A1 7/2005 Holowczak et al.
2006/0083613 A1 4/2006 Cunha et al.
2006/0083614 A1 4/2006 Cunha et al.
2006/0093480 A1 5/2006 Cunha et al.
2006/0107668 A1 5/2006 Cunha et al.
2006/0239819 A1 10/2006 Albert et al.
2006/0263221 A1 11/2006 Cunha et al.
2007/0048122 A1 3/2007 Van Suetendael, IV et al.
2007/0048128 A1 3/2007 Cunha et al.
2007/0048134 A1 3/2007 Cunha et al.
2007/0104576 A1 5/2007 Cunha et al.
2007/0116566 A1 5/2007 Cunha et al.
2007/0116568 A1 5/2007 Cunha et al.
2007/0116569 A1 5/2007 Cunha et al.
2007/0147997 A1 6/2007 Cunha et al.
2007/0172355 A1 7/2007 Cunha et al.
2007/0177975 A1 8/2007 Luczak et al.
2007/0177976 A1 8/2007 Cunha et al.
2007/0224048 A1 9/2007 Abdel-Messeh et al.
2007/0227706 A1 10/2007 Lutjen et al.
2007/0237638 A1 10/2007 Sharma et al.
2007/0248462 A1 10/2007 Lutjen et al.
2007/0286735 A1 12/2007 Cunha et al.
2008/0008599 A1 1/2008 Cunha et al.
2008/0019839 A1 1/2008 Cunha et al.
2008/0019840 A1 1/2008 Cunha
2008/0019841 A1 1/2008 Cunha
2008/0056909 A1 3/2008 Cunha et al.
2010/0054953 A1 3/2010 Piggush

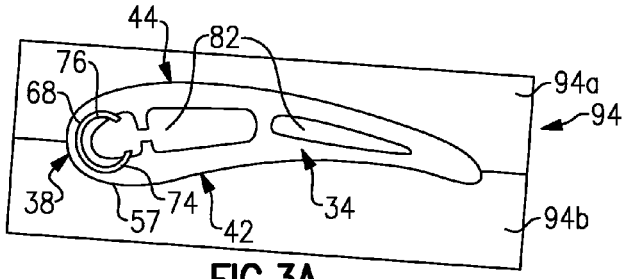
FIG.3A
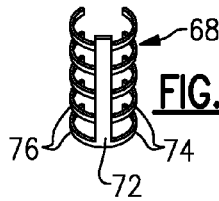
FIG.3B
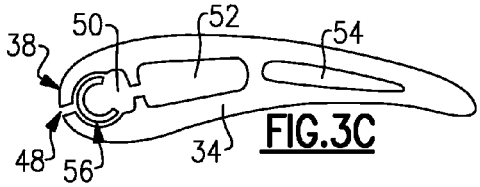
FIG.3C
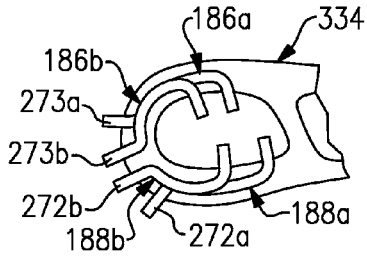
FIG.6A
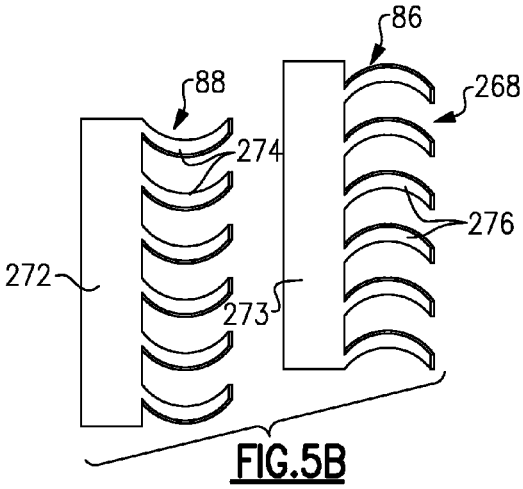
FIG.5B
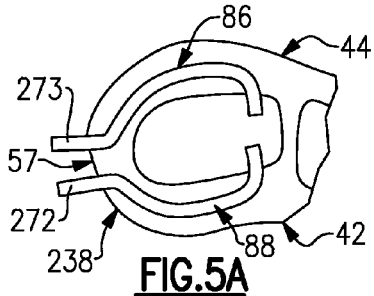
FIG.5A
FIG.4B
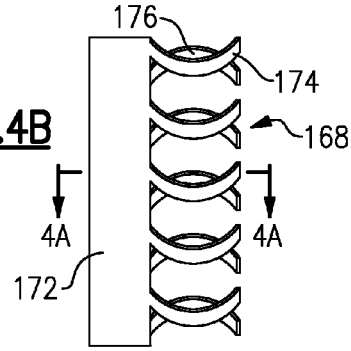
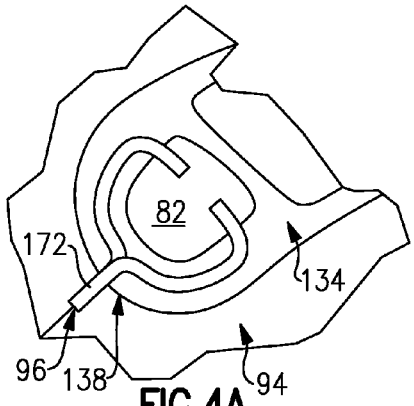
FIG.4A

AIRFOIL WITH WRAPPED LEADING EDGE COOLING PASSAGE

This application is a divisional application of U.S. Ser. No. 12/334,665, filed on Dec. 15, 2008, now U.S. Pat. No. 8,109, 725, issued on Feb. 7, 2012.

BACKGROUND

This disclosure relates to a cooling passage for an airfoil.

Turbine blades are utilized in gas turbine engines. As known, a turbine blade typically includes a platform having a root on one side and an airfoil extending from the platform opposite the root. The root is secured to a turbine rotor. Cooling circuits are formed within the airfoil to circulate cooling fluid, such as air. Typically, multiple relatively large cooling channels extend radially from the root toward a tip of the airfoil. Air flows through the channels and cools the airfoil, which is relatively hot during operation of the gas turbine engine.

Some advanced cooling designs use one or more radial cooling passages that extend from the root toward the tip near a leading edge of the airfoil. Typically, the cooling passages are arranged between the cooling channels and an exterior surface of the airfoil. The cooling passages provide extremely high convective cooling.

Cooling the leading edge of the airfoil can be difficult due to the high external heat loads and effective mixing at the leading edge due to fluid stagnation. Prior art leading edge cooling arrangements typically include two cooling approaches. First, internal impingement cooling is used, which produces high internal heat transfer rates. Second, showerhead film cooling is used to create a film on the external surface of the airfoil. Relatively large amounts of cooling flow are required, which tends to exit the airfoil at relatively cool temperatures. The heat that the cooling flow absorbs is relatively small since the cooling flow travels along short paths within the airfoil, resulting in cooling inefficiencies.

One arrangement that has been suggested to convectively cool the leading edge is a cooling passage wrapped at the leading edge. This wrapped leading edge cooling passage is formed by a refractory metal core that is secured to another core. The cores are placed in a mold, and a superalloy is cast into the mold about the cores to form the airfoil. The cores are removed from the cast airfoil to provide the cooling passages. However, in some applications, the wrapped leading edge cooling passage does not provide the amount of desired cooling to the leading edge.

What is needed is a leading edge cooling arrangement that provides desired cooling of the airfoil.

SUMMARY

A turbine engine airfoil includes an airfoil structure having an exterior surface providing a leading edge. A radially extending first cooling passage is arranged near the leading edge and includes first and second portions. The first portion extends to the exterior surface and forms a radially extending trench in the leading edge. The second portion is in fluid communication with a second cooling passage. In one example, the second cooling passage extends radially, and the first cooling passage wraps around a portion of the second cooling passage from a pressure side to a suction side between the second cooling passage and the exterior surface. In the example, the first portion is arranged between the pressure and suction sides. In one example, the first cooling passage is formed by arranging a core in an airfoil mold. The trench is formed by the core in one example.

These and other features of the disclosure can be best understood from the following specification and drawings, the following of which is a brief description.

BRIEF DESCRIPTION OF THE DRAWINGS

FIG. 3A is a cross-sectional view of a portion of the airfoil shown in FIG. 2 and taken along 3A-3A.

FIG. 3B is a perspective view of a core that provides the wrapped leading edge cooling passage shown in FIG. 3A.

FIG. 3C is a cross-sectional view of the airfoil shown in FIG. 3A with the core removed from the airfoil and a trench formed in the leading edge.

FIG. 4A is a partial cross-sectional view of another airfoil leading edge with another example core.

FIG. 4B is a perspective view of the core shown in FIG. 4A.

FIG. 5A is a partial cross-sectional view of yet another airfoil leading edge with yet another example core.

FIG. 5B is a perspective view of the core shown in FIG. 5A.

FIG. 6A is a partial cross-sectional view of still another airfoil leading edge with still another example core.

DETAILED DESCRIPTION

Figure 1:
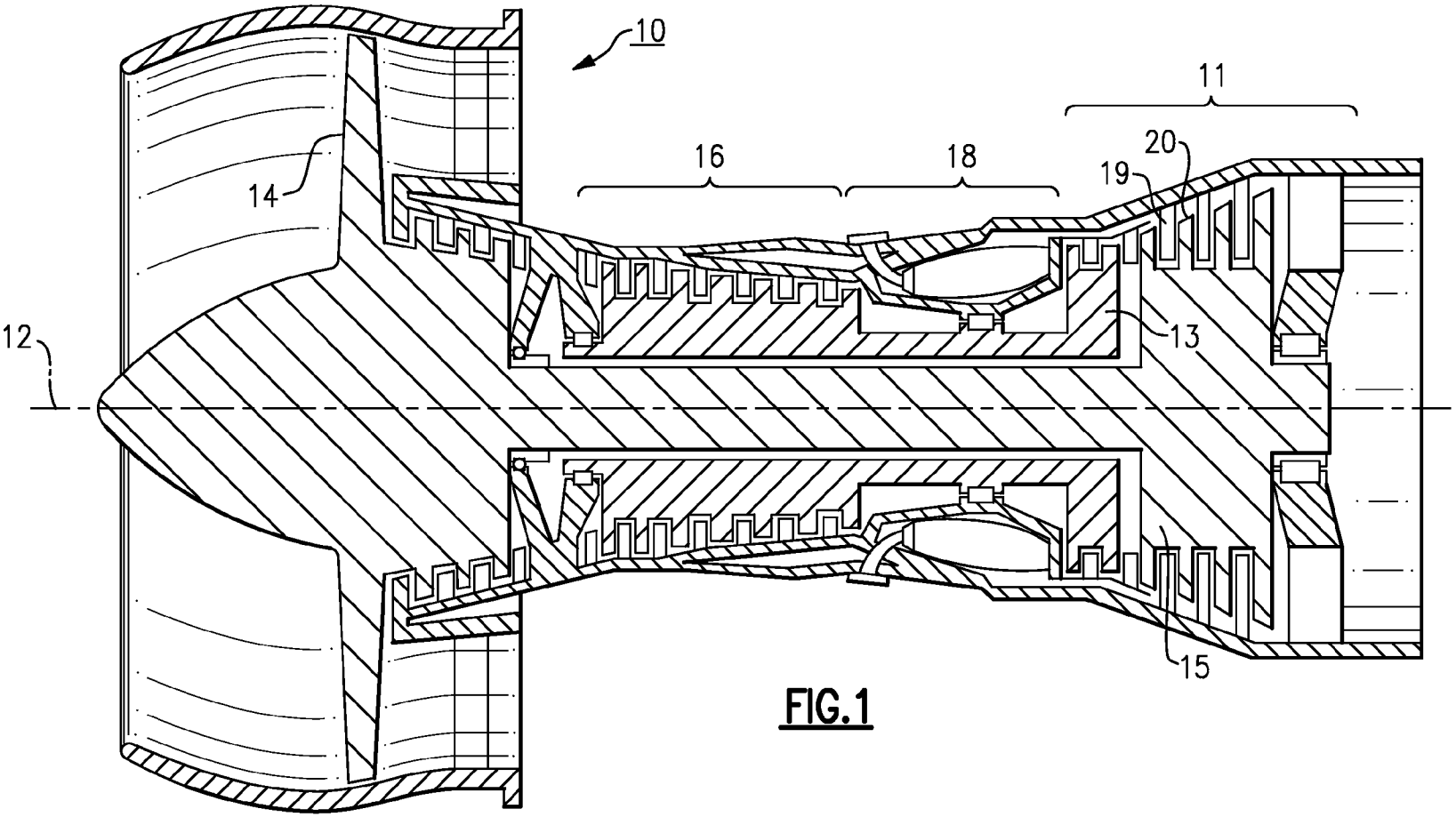
FIG. 1 is a schematic view of a gas turbine engine incorporating the disclosed airfoil.

FIG. 1 schematically illustrates a gas turbine engine 10 that includes a fan 14, a compressor section 16, a combustion section 18 and a turbine section 11, which are disposed about a central axis 12. As known in the art, air compressed in the compressor section 16 is mixed with fuel that is burned in combustion section 18 and expanded in the turbine section 11. The turbine section 11 includes, for example, rotors 13 and 15 that, in response to expansion of the burned fuel, rotate, which drives the compressor section 16 and fan 14.

The turbine section 11 includes alternating rows of blades 20 and static airfoils or vanes 19. It should be understood that FIG. 1 is for illustrative purposes only and is in no way intended as a limitation on this disclosure or its application.

Figure 2:
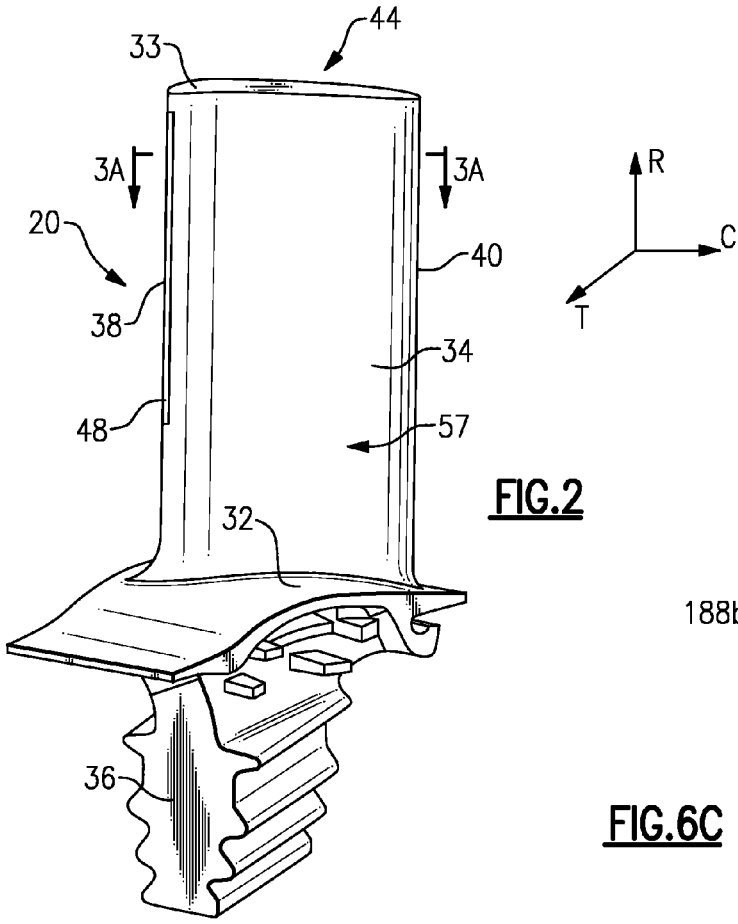
FIG. 2 is a perspective view of the airfoil having the disclosed cooling passage.

An example blade 20 is shown in FIG. 2. The blade 20 includes a platform 32 supported by a root 36, which is secured to a rotor. An airfoil 34 extends radially outwardly from the platform 32 opposite the root 36. While the airfoil 34 is disclosed as being part of a turbine blade 20, it should be understood that the disclosed airfoil can also be used as a vane.

The airfoil 34 includes an exterior surface 57 extending in a chord-wise direction C from a leading edge 38 to a trailing edge 40. The airfoil 34 extends between pressure and suction sides 42, 44 in an airfoil thickness direction T, which is generally perpendicular to the chord-wise direction C. The airfoil 34 extends from the platform 32 in a radial direction R to an end portion or tip 33. A cooling trench 48 is provided on the leading edge 38 to create a cooling film on the exterior surface 57. In the examples, the trench 48 is arranged in proximity to a stagnation line on the leading edge 38, which is an area in which there is little or no fluid flow over the leading edge.

FIG. 3A schematically illustrates an airfoil molding process in which a mold 94 having mold halves 94A, 94B provide a mold contour that defines the exterior surface 57 of the airfoil 34. In one example, cores 82, which may be ceramic, are arranged within the mold 94 to provide the cooling channels 50, 52, 54 (FIG. 3C). Referring to FIG. 3C, multiple, relatively large radial cooling channels 50, 52, 54 are provided internally within the airfoil 34 to deliver airflow for cooling the airfoil. The cooling channels 50, 52, 54 typically provide cooling air from the root 36 of the blade 20.

Current advanced cooling designs incorporate supplemental cooling passages arranged between the exterior surface 57 and one or more of the cooling channels 50, 52, 54. With continuing reference to FIG. 3A, the airfoil 34 includes a first cooling passage 56 arranged near the leading edge 38. The first cooling passage 56 is in fluid communication with the cooling channel 50, in the example shown. One or more core structures 68 (FIGS. 3A and 3B), such as refractory metal cores, are arranged within the mold 94 and connected to the other cores 82. The core structure 68, which is generally C-shaped, provides the first cooling passage 56 in the example disclosed. In one example, the core structure 68 (shown in FIG. 3B) is stamped from a flat sheet of refractory metal material. The core structure 68 is then bent or shaped to a desired contour. The ceramic core and/or refractory metal cores are removed from the airfoil 34 after the casting process by chemical or other means.

A core assembly can be provided in which a portion of the core structure 68 is received in a recess of the other core 82, as shown in FIG. 3A. In this manner, the resultant first cooling passage 56 provided by the core structure 68 is in fluid communication with the cooling channel 50 subsequent to the airfoil casting process.

The core structure 68 includes a first portion 72 and a second portion. In the example shown in FIGS. 3A-3C, the second portion includes multiple, radially spaced first and second sets of arcuate legs 74, 76 that wrap around a portion of the cooling channel 50. The shape of the legs 74, 76 generally mirror the exterior surface 57 of the leading edge 38. The first and second sets of legs 74, 76 are secured to the other core 82. One set of legs 74 is arranged on the pressure side 42 and the other set of legs 76 is arranged on the suction side 44. In the example shown in FIGS. 3A-3C, the first portion 72 does not extend to the exterior surface 57. The trench 48 is formed by a chemical or mechanical machining process, for example, to fluidly connect the first portion 72 to the leading edge 38. Cooling fluid is provided from the first cooling channel 50 through the first cooling passage 56 to provide a cooling film on the leading edge 38 via the trench 48.

Referring to FIGS. 4A and 4B, a core structure 168 is shown that provide the trench 48 during the casting process. The first portion 172 extends beyond the exterior surface and into the mold 94 where the first portion 172 is held by a core retention feature 96, which is provided by a notch in the mold 94, for example. Thus, when the core structure 168 is removed from the airfoil 134, a trench will be provided at the leading edge 138. The legs 174, 176 are at an angle or transverse laterally to the first portion 172. The example core structure 168 provides first and second sets of legs 174, 176 on opposite sides and in radially spaced, alternating relationship from one another. The first portion 172 extends in a direction opposite the other core 82.

Figure 5C:
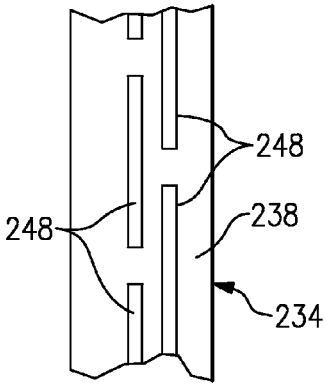
FIG. 5C is a front elevational view of the leading edge shown in FIG. 5A.

The first cooling passage can be provided by multiple separate networks of passageways, as illustrated in FIGS. 5A and 5B. The networks of passageways are formed with multiple core structures 86, 88 having first portions 272, 273 that are discrete from one another. One of the cores structures 86 is arranged on the suction side 44 and the other core structure 88 is arranged on the pressure side 42. The legs 274, 276 are only fluidly connected to one another through the cooling channel 50. The first portions 272, 273 extend beyond the exterior surface 57 in the leading edge 238 and can be configured to provide laterally and/or radially staggered trenches 248 on the airfoil 234, as shown in FIG. 5C.

Figure 6C:
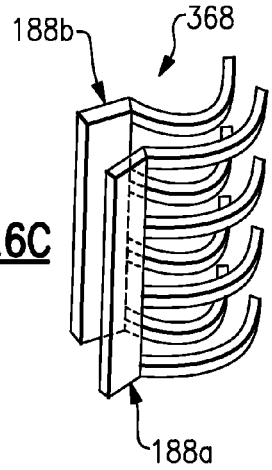
FIG. 6C is a perspective view of a portion of the core shown in FIG. 6A.
Figure 6B:
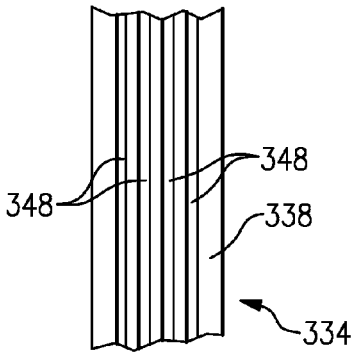
FIG. 6B is a front elevational view of the leading edge shown in FIG. 6A.

Another arrangement of multiple networks of passageways is shown in FIGS. 6A-6C. The first cooling passage is provided by two networks of passageways created by core structures 186*a*, 186*b*, 188*a*, 188*b* provided on each of the pressure and suction sides 42, 44 of airfoil 334. The core structures 186*a*, 186*b*, 188*a*, 188*b* respectively provide discrete first portions 273*a*, 273*b*, 272*a*, 272*b* that create trenches 348 in leading edge 338, shown in FIG. 6B.

Although example embodiments have been disclosed, a worker of ordinary skill in this art would recognize that certain modifications would come within the scope of the claims. For that reason, the following claims should be studied to determine their true scope and content.

What is claimed is:

1. A core for manufacturing an airfoil comprising:

a core structure having a generally flat first portion extending in a first direction, and a second portion interconnected to and extending transversely from the first portion in a second direction, the second portion including multiple arcuate legs spaced apart from one another along the first direction, wherein the first portion is a planar structure extending in the first and second directions for forming a trench in a leading edge of the airfoil.

2. The core according to claim 1, wherein the second portion includes a first set of legs extending from the first portion to one side of the first portion, and a second set of legs extending from the first portion to another side of the first portion opposite the one side, the first and second sets of legs spaced from one another in a third direction that is transverse to the first and second directions and in alternating relationship with one another along the first direction.

3. The core according to claim 2, wherein the core structure is secured to another core structure, the first portion spaced from the other core structure and extending away from the other core structure.

4. The core according to claim 2, wherein there are no legs between the first and second sets of alternating legs in the first direction.

5. The core according to claim 1, wherein the first and second portions adjoin one another at an intersection, and the second portion extends away from the first portion at the intersection at an obtuse angle relative to the planar structure.

6. The core according to claim 1, wherein the core is constructed from a refractory metal.

7. The core according to claim 1, wherein the second portion has a quadrangular cross-section.

8. The core according to claim 3, wherein the first and second sets of legs respectively terminate in first and second ends, the first and second ends aligned with one another and supported by opposing sides of the other core structure.

9. The core according to claim 1, wherein the first portion has a rectangular cross-sectional area.

* * * * *